US005847738A

United States Patent [19]

Tutt et al.

[11] Patent Number: 5,847,738

[45] **Date of Patent: *Dec. 8, 1998**

[54] PROCESS FOR APPLYING PROTECTIVE OVERCOAT ON PRINTED MEDIA

[75] Inventors: Lee W. Tutt, Webster; Scott E. Tunney, Ontario, both of N.Y.

[73] Assignee: Eastman Kodak Company, Rochester, N.Y.

[ * ] Notice: The term of this patent shall not extend beyond the expiration date of Pat. No. 5,672,458.

[21] Appl. No.: 893,800

[22] Filed: Jul. 11, 1997

[51] Int. Cl.[6] ..... B41J 2/01; B41F 7/00

[52] U.S. Cl. ..... 347/101; 347/105; 101/170; 101/492

[58] Field of Search ..... 347/101, 105; 101/170, 492, 154

[56] References Cited

U.S. PATENT DOCUMENTS

| | | | |
|---|---|---|---|
| 5,045,888 | 9/1991 | Imaeda | 355/285 |
| 5,101,216 | 3/1992 | Mey et al. | 347/100 |
| 5,201,268 | 4/1993 | Yamamoto et al. | 101/170 |
| 5,339,146 | 8/1994 | Aslam et al. | 355/282 |
| 5,605,750 | 2/1997 | Romano et al. | 347/105 |
| 5,672,458 | 9/1997 | Tutt et al. | 430/124 |

*Primary Examiner*—Valerie Lund
*Assistant Examiner*—Christina Annick
*Attorney, Agent, or Firm*—Harold E. Cole

[57] ABSTRACT

A process of forming an overcoat on a printed image to provide improved stability comprising:

a) applying an image layer on a substrate using a liquid ink to form an imaged element;

b) either charging the imaged element to a given polarity or applying a voltage across the surface of the element which is attracted to a conductive surface behind the element;

c) applying colorless, charged particles to the element which causes them to be electrostatically attracted to the surface of the image layer; and d) heat-fusing the particles to obtain a protective overcoat over the entire surface of the image layer.

5 Claims, No Drawings

PROCESS FOR APPLYING PROTECTIVE OVERCOAT ON PRINTED MEDIA

CROSS REFERENCE TO RELATED APPLICATIONS

Reference is made to commonly-assigned U.S. patent application Ser. Nos. 08/681,582, filed 29 Jul. 1996, entitled "Laser Dye or Pigment Removal Imaging Process" by Tutt et al; and Ser. No. 08/681,677, filed 29 Jul. 1996, entitled "Overcoat for Thermal Imaging Process" by Tutt et al.; the disclosures of which are hereby incorporated by reference.

FIELD OF THE INVENTION

This invention relates to a process of providing an electrostatically applied protective overcoat on printed elements produced by different print engines on the market, such as ink jet printers, offset presses, etc.

BACKGROUND OF THE INVENTION

With more widespread use by the public of various printing and imaging technologies in the publishing industry as well as at home, it has become desirable to provide protection for the imaged or printed documents against abrasion, transfer to poly(vinyl chloride) cover materials, water or alcohol spills, ink smear, or other image print degradation processes and detrimental effects from the surroundings.

One way to improve abrasion resistance of an element is to use lamination. Lamination involves placing a durable and/or adhesive protective layer coated on a suitable support to the image which is to be protected. The support of the protective coating may remain permanently adhered or it may subsequently be peeled off leaving only the protective layer adhered to the image. Lamination has several disadvantages in that it brings about an added expense associated with coating an additional support. In addition, air pockets may be trapped during the laminating step leading to image defects.

Another commonly used method for protecting images from surface damage is to apply a liquid overcoat. This method may avoid the problem of air trapping, but has many other problems, such as handling of liquids which may be messy or difficult to dry and cure, and the use of environmentally undesirable solvents.

DESCRIPTION OF RELATED ART

Electrostatic deposition of charged toner particles to a photoconductor carrying an oppositely charged image pattern, subsequent transfer of the toner image to a suitable receiver and heat fusing the toner particles to generate a final image is a well-known process in the electrophotographic art. In addition, charged, clear toners have been applied to electrostatically-generated images as disclosed in U.S. Pat. Nos. 5,339,146 and 5,045,888; and in Japanese Kokoku 84/025214. However, these references do not disclose the use of such toners as a protective layer applied by a post-imaging step to an imaged or printed element using a liquid ink.

It is an object of this invention to provide a process for applying an overcoat layer on a printed or imaged element, which is applied after printing or imaging, so that the overcoat layer covers the entire surface of the element. It is another object of the invention to provide such a process to improve the stability of the resulting image from abrasion and retransfer to unwanted surfaces.

SUMMARY OF THE INVENTION

These and other objects are achieved in accordance with the invention which relates to a process of forming an overcoat on a printed image to provide improved stability comprising:

a) applying an image layer on a substrate using a liquid ink to form an imaged element;

b) either charging the imaged element to a given polarity or applying a voltage across the surface of the element which is attracted to a conductive surface behind the element;

c) applying colorless, charged particles to the element which causes them to be electrostatically attracted to the surface of the image layer; and d) heat-fusing the particles to obtain a protective overcoat over the entire surface of the image layer.

DESCRIPTION OF THE PREFERRED EMBODIMENTS

The protective overcoat applied by the process of this invention improves the scratch- and abrasion-resistance of the element, and improves the retransfer resistance to unwanted surfaces.

In a preferred embodiment of the invention, the image is obtained using an inkjet process. Ink jet processes are well known in the art. In such a process, a printing head delivers a liquid ink to a substrate, such as paper, by ejecting droplets of the ink across a gap. Printers using this process are sold commercially by many companies.

In another preferred embodiment of the invention, the image is obtained using an offset or gravure process. Offset printing processes are well known in the art. In offset printing, a cylinder containing ink-receptive image areas, picks up ink from a receptacle, transfers the ink to an intermediate roller, which then transfers the ink to the final substrate, such as paper. This process is repeated for each color desired.

Gravure printing is also well known in the art. Gravure printing is similar to offset printing, except that the cylinder has indentations which pick up ink, rather than having ink-receptive areas. An offset roller may also not be necessary in some instances.

This invention is useful for processes which provide an image on a substrate which employs a liquid ink. Liquid inks are utilized in the ink jet printing process, as well as the offset and gravure processes described above, and also include offset inks. Such inks are well known in the art and require no further definition.

As noted above, after imaging, the imaged element is either charged to a given polarity or a voltage is applied across the surface of the element which is attracted to a conductive surface behind the element. Charging the surface of the element may be accomplished, for example, by using a high voltage corona which charges the entire surface of the imaged element. For example, a high voltage power supply can be connected to a wire suspended over the surface of the element, the surface layer being grounded. When the high voltage is applied, ions will be deposited on the surface of the element, the polarity of which is determined by the polarity of the voltage applied. This is well known in the electrophotographic art, as shown, for example, by U.S. Pat. Nos. 4,478,870; 4,423,951 and 4,041,312, the disclosures of which are hereby incorporated by reference.

Another method of attracting toner particles to the surface of the imaged element is to use a technique called biased development. This method involves applying a voltage across the surface of the element which is attracted to a conductive surface, such as a metal surface, behind the element. This method creates a mechanism whereby particles will become attracted to the surface of the imaged element.

The toner particles may be charged, for example, by agitating the toner particles with a magnetic carrier, such as ferrite particles, in a mixing chamber. The charge level and polarity of the toner can be adjusted by the addition of charge control agents to the toner or polymer coatings on the magnetic carrier. This can take place in a matter of several seconds up to a minute. This is well known in the electrophotographic art, as shown, for example, by U.S. Pat. No. 4,546,060, the disclosure of which is hereby incorporated by reference.

After the toner particles are mixed and charged, they are transported, usually by rotating magnets contained in a shell, to an offset roller. The particles are then attracted and then transferred to the imaged element by electrostatic forces using one of the techniques described above.

After the colorless, oppositely-charged particles are applied to the surface of the element, the particles are heat- and/or pressure-fused to obtain a protective overcoat over the entire image. This can be accomplished by passing the imaged element through a pair of heated rollers, heated to a temperature of, for example, 100° C. to about 200° C., using a pressure of about $6.9\times10^3$ to about $8.3\times10^4$ Pa (10–120 psi) at a transport rate of about 0.005 m/s to about 0.50 m/s. This is well known in the electrophotographic art, as shown, for example, by U.S. Pat. No. 3,861,863, the disclosure of which is hereby incorporated by reference.

Colorless toner particles, well-known in the electrophotographic art, may be used in the process of this invention. There can be used, for example, those materials disclosed in U.S. Pat. Nos. 5,339,146; 5,045,888; and in Japanese Kokai 50/023826, the disclosures of which are hereby incorporated by reference. Examples of such materials include resins which are generally colorless, or almost colorless and transparent, and the softening point of which is in the range of from about 50° to about 150° C.

Examples of such particles include poly(vinyl chloride), poly(vinylidene chloride), poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, gum damar, ketone resins, maleic acid resins, vinyl polymers such as polystyrene and polyvinyltoluene or copolymers of vinyl polymers with methacrylates or acrylates, low-molecular weight polyethylene, phenol-modified pentaerythritol esters, poly(styrene-co-indene-co-acrylonitrile), poly(styrene-co-indene), poly(styrene-co-acrylonitrlile), copolymers with siloxanes, polyalkenes and poly(styrene-co-butadiene), which may be used either alone or in combination. In a preferred embodiment of the invention, the colorless particles are made of either a polyester or poly(styrene-co-butyl acrylate).

To increase the abrasion resistance of the overcoat layer, polymers which are crosslinked or branched can be used. For example, there can be used, poly(styrene-co-indene-co-divinylbenzene), poly(styrene-co-acrylonitrile-co-divinylbenzene) or poly(styrene-co-butadiene-co-divinylbenzene).

Any material can be used as the support for the imaged element employed in the invention. Such materials include paper; polyesters such as poly(ethylene naphthalate); poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 2000 $\mu$m. In a preferred embodiment, the support is paper or poly(vinyl chloride).

The following example is provided to illustrate the invention.

EXAMPLE

Printed media of various types were either obtained commercially or printed in a manner which gave black images. These images were used for evaluation and testing since such prints correspond to the maximum amount of color present in an image. Thus, the greatest possibility of observable damage exists in such prints, since no dye or pigment would be lost from areas which do not contain any such colorants.

The following test samples were assembled:

E-1: On an HP Deskjet® 870CXI ink jet printer, a black patch was printed in normal printing mode on Colormark® Waterfast Removable Vinyl available from Lasermaster Co.

E-2: On an HP Deskjet® 870CXI ink jet printer, a black patch was printed in normal printing mode on DMVLA5 (a removable vinyl material) from Color Ink Jet Products, Rexham Graphics.

E-3: Sensational Spiderman, May 97, Marvel Comics Group, advertisement containing predominately black on the back of page 21. This is an example of offset lithography.

E-4: On an HP Deskjet® 870CXI ink jet printer, a black patch was printed in normal printing mode on HP Glossy Premium Media. The black ink used by HP is pigment-based.

E-5: On an HP Deskjet® 870CXI ink jet printer, a black patch was printed in normal printing mode on plain paper. The black ink used by HP is pigment-based.

E-6: On an Epson Stylus® 600 ink-jet printer, a black patch was printed on plain paper in 360 dpi normal mode. Epson uses dye-based black inks.

E-7: Page 24 of National Geographic Volume 190, No. 5 11/96, a predominately black image, an example of gravure printed media.

Electrostatic Toning

Electrostatic toning was accomplished by placing 800 g of polymer and magnetic carrier particles in a toner holder. The carrier consisted of particles of an iron strontium (6:1) ceramic material with a nominal size of 30–50 $\mu$m. The carrier transported the toner by means of rotating magnets in a shell. The image element was attached to a grounded conductive drum and rotated at 5.1 cm/sec approximately 0.076 cm above the shell. A bias of −700 V was applied to the shell to transfer the toner to the imaged element coating in the amounts listed in Table 1. The toner was a polyester toner, Kao P® (KAO Inc., Racine Wis.). The toned image element was then run through a pair of heated rollers at 5.1 cm per sec with a contact roller temperature of 132° C. and a back roller temperature of 88° C.

Abrasion Testing

The resultant image element with the protective coating along with a non-processed image element was tested using a standard Tabor test which consists of a spinning disk which rotates around on the sample 50 cycles and with 125 g of mass as weight. This results in abrasion of the sample in a reproducible fashion. The abrasion of the samples is measured by recording the average of 5 readings of the Status A visible reflection density in the abraded and unabraded region on an X-Rite Densitometer Model 820 (X-Rite, Corp.).

The Murray-Davies Equation was then used (assuming a 0.0 Dmin) to determine the percentage printed area lost (abraded) as shown in Table 1. The Murray-Davies equation has been described by A. Murray in J. Franklin Inst. 221, 721–244 (June 1936).

TABLE 1

| Sample # | Toner Lay-down g/m$^2$ | Status A Visible Density Not abraded | Status A Visible Density Abraded | Murray-Davies Equation (assume 0.0 Dmin) % Area Lost |
|---|---|---|---|---|
| E-1 Uncoated | | 1.26 | 1.15 | 1.6 |
| E-1 Coated | 9.3 | 1.60 | 1.42 | 1.3 |
| E-2 Uncoated | | 1.51 | 1.16 | 4.0 |
| E-2 Coated* | 5.1 | 1.48 | 1.24 | 2.5 |
| E-3 Uncoated | | 1.30 | 1.16 | 1.9 |
| E-3 Coated | 11 | 1.67 | 1.43 | 1.6 |
| E-4 Uncoated | | 2.14 | 1.69 | 1.3 |
| E-4 Coated | 3.7 | 2.56 | 1.85 | 1.1 |
| E-5 Uncoated | | 1.21 | 1.11 | 1.8 |
| E-5 Coated | 4.2 | 1.59 | 1.44 | 1.1 |
| E-6 Uncoated | | 1.30 | 1.27 | 0.3 |
| E-6 Coated | 3.1 | 1.49 | 1.37 | 1.1 |
| E-7 Uncoated | | 2.09 | 1.34 | 3.8 |
| E-7 Coated | 2.8 | 2.19 | 1.66 | 1.5 |

*bias voltage −800 V

The above results show that in all cases, a protective overcoat derived from fusing clear toner particles over the sample surface improves the protection of the image from abrasion. This is readily noted by the decrease in the % area lost in all samples except E-6. In E-6, the loss is so very small in the uncoated media (0.3) that changes in the gloss begin to dominate. Gloss changes give rise to increased densities upon coating in all cases. Visually, all samples appeared less damaged upon abrasion when coated.

Water Fastness

To measure water fastness of the image element, a cotton swab was dipped into distilled water and gently wiped on the surface. The amount of color transferred to the cotton swab was rated on a scale as indicated in Table 2. In addition, if the wiping test was noticeable on the image element after the water had dried, then that observation was recorded. The following results were obtained:

TABLE 2

| Sample # | Toner Laydown g/m$^2$ | Water Test-Cotton Swab Wipe* | Water Test-Image Degradation Observed |
|---|---|---|---|
| E-1 Uncoated | | 1 | No |
| E-1 Coated | 9.3 | 0 | No |

TABLE 2-continued

| Sample # | Toner Laydown g/m$^2$ | Water Test-Cotton Swab Wipe* | Water Test-Image Degradation Observed |
|---|---|---|---|
| E-2 Uncoated | | 3 | Yes |
| E-2 Coated | 5.1 | 2 | Somewhat |
| E-3 Uncoated | | 0 | No |
| E-3 Coated | 11 | 0 | No |
| E-4 Uncoated | | 3 | Yes |
| E-4 Coated | 3.7 | 0 | No |
| E-5 Uncoated | | 1 | Yes |
| E-5 Coated | 4.2 | 0 | No |
| E-6 Uncoated | | 1 | Yes |
| E-6 Coated | 3.1 | 0 | No |
| E-7 Uncoated | | 0 | No |
| E-7 Coated | 2.8 | 0 | No |

*0 - no color on swab
1 - light color
2 - moderate
3 - dark

The above results show that for all sample test media, the overcoated image elements performed better or equal to all uncoated image elements (water test-cotton swab wipe shows less color removed from the coated samples). In addition, image degradation was generally less for the coated samples.

The invention has been described in detail with particular reference to preferred embodiments thereof, but it will be understood that variations and modifications can be effected within the spirit and scope of the invention.

What is claimed is:

1. A process of forming an overcoat on a printed image to provide improved stability comprising the steps of:

a) forming a liquid ink image on a substrate using an ink jet, offset or gravure process to form an imaged element;

b) either charging said imaged element to a given polarity or applying a voltage across the surface of said element which is attracted to a conductive surface behind said element;

c) applying colorless, charged particles to said element which causes the particles to be electrostatically attracted to the surface of said imaged element; and d) heat-fusing said particles to obtain a protective overcoat over the entire surface of said imaged element.

2. The process of claim 1 wherein said colorless particles comprise either a polyester or poly(styrene-co-butyl acrylate).

3. The process of claim 1 wherein step b) is performed by applying a voltage across the surface of said element which is attracted to a metal surface behind said element.

4. The process of claim 1 which further comprises the use of paper as the substrate in step a).

5. The process of claim 1 which further comprises the use of poly(vinyl chloride) as the substrate in step a).

* * * * *